US010917724B1

(12) United States Patent
Chen

(10) Patent No.: US 10,917,724 B1
(45) Date of Patent: Feb. 9, 2021

(54) SOUND SOURCE SEPARATION METHOD, SOUND SOURCE SUPPRESSION METHOD AND SOUND SYSTEM

(71) Applicant: U-MEDIA Communications, Inc., Hsinchu (TW)

(72) Inventor: Yu-Chuan Chen, Nantou County (TW)

(73) Assignee: U-MEDIA Communications, Inc., Hsinchu (TW)

( * ) Notice: Subject to any disclaimer, the term of this patent is extended or adjusted under 35 U.S.C. 154(b) by 0 days.

(21) Appl. No.: 16/711,460

(22) Filed: Dec. 12, 2019

(30) Foreign Application Priority Data

Oct. 14, 2019 (TW) ..... 108136840 A

(51) Int. Cl.
*H04R 3/00* (2006.01)
*H04R 5/04* (2006.01)
*H04R 3/04* (2006.01)

(52) U.S. Cl.
CPC ..... *H04R 5/04* (2013.01); *H04R 3/005* (2013.01); *H04R 3/04* (2013.01)

(58) Field of Classification Search
CPC ..... H04R 3/005; H04R 1/406; H04R 1/32; H04R 1/326; H04R 1/40; H04R 2201/401; H04R 2430/20; H04R 2430/23; H04R 25/407; G01S 3/8083; G10L 2021/02166; G10L 21/0208; G10K 11/341
See application file for complete search history.

(56) References Cited

U.S. PATENT DOCUMENTS 9,955,277 B1 * 4/2018 Alexandridis ..... H04S 7/30
2004/0252845 A1 12/2004 Tashev
2018/0124222 A1 5/2018 Hosoi

FOREIGN PATENT DOCUMENTS

CN 101534413 A 9/2009
TW 517467 1/2003

* cited by examiner

*Primary Examiner* — Kile O Blair
(74) *Attorney, Agent, or Firm* — Winston Hsu

(57) ABSTRACT

A sound source separation method, applied in a sound system, is provided. The method comprises choosing a maximum sound source signal and at least a non-maximum sound source signal from a plurality of sound source signals; multiplying the at least a non-maximum sound source signal by at least a suppression value, to generate at least a suppressed sound source signal; and performing a back-end sound source extraction operation on the maximum sound source signal and the at least a suppressed sound source signal.

12 Claims, 2 Drawing Sheets

SOUND SOURCE SEPARATION METHOD, SOUND SOURCE SUPPRESSION METHOD AND SOUND SYSTEM

BACKGROUND OF THE INVENTION

1. Field of the Invention

The present invention relates to a sound source separation method, a sound source suppression method, and a sound system, and more particularly, a high separation performance sound source separation method, sound source suppression method, and sound system.

2. Description of the Prior Art

Since there are various noise sources in the environment, it is difficult to satisfy the quality requirements to record the target sound by microphone merely in different environments. Therefore, some noise reduction processing or sound source separation method is required.

It exists a problem of the signal separation being not sufficiently clear in the prior art. Therefore, it is necessary to improve the prior art.

SUMMARY OF THE INVENTION

It is, therefore, a primary objective of the present invention to provide high separation performance sound source separation method, sound source suppression method, and sound system to improve over disadvantages of the prior art.

An embodiment of the present invention discloses a sound source separation method, applied to a sound system, wherein the sound system comprises a microphone array, a sound source localization module, a sound source signal generating module, a sound source suppression module, and a back-end module, the method comprising the microphone array receiving a received signal; the sound source localization module generating a plurality of sound source positions corresponding to a plurality of sound sources; the sound source signal generating module computing a plurality of sound source signal corresponding to the plurality of sound sources according to the received signal and the plurality of sound source positions; the sound source suppression module choosing a maximum sound source signal and at least one non-maximum sound source signal from the plurality of sound source signals, wherein the plurality of sound source signals have a plurality of amplitudes, and the maximum sound source signal has a maximum amplitude of the plurality of amplitudes; the sound source suppression module multiplying the at least one non-maximum sound source signals by at least one suppression value, to generate at least one suppressed sound source signal, wherein the at least one suppression value is less than 1; and the back-end module performing a back-end sound source extraction operation to the maximum sound source signal and the at least one suppressed sound source signals.

An embodiment of the present invention further discloses a sound source suppression method, applied to a sound source suppression module, comprising receiving a plurality of sound source signals corresponding to a plurality of sound sources; choosing a maximum sound source signal and at least one non-maximum sound source signal from the plurality of sound source signals, wherein the plurality of sound source signals have a plurality of amplitudes, and the maximum sound source signal has a maximum amplitude of the plurality of amplitudes; multiplying the at least one non-maximum sound source signals by at least one suppression value, to generate at least one suppressed sound source signal, wherein the at least one suppression value is less than 1; and transmitting the maximum sound source signal and the at least one suppressed sound source signal to a back-end module; wherein, the back-end module performing a back-end sound source extraction operation to the maximum sound source signal and the at least one suppressed sound source signal.

An embodiment of the present invention further discloses a sound system, comprising a microphone array, configured to receive a received signal; a sound source localization module, configured to generate a plurality of sound source positions corresponding to a plurality of sound sources; a sound source signal generating module, configured to calculate the plurality of sound source signal corresponding to the plurality of sound sources according to the received signal and the plurality of sound source positions; a sound source suppression module, configured to perform the following steps: choosing a maximum sound source signal and at least one non-maximum sound source signal from the plurality of sound source signals, wherein the plurality of sound source signals have a plurality of amplitudes, and the maximum sound source signal has a maximum amplitude of the plurality of amplitudes; and multiplying the at least one non-maximum sound source signals by at least one suppression value, to generate at least one suppressed sound source signal, wherein the at least one suppression value is less than 1; and a back-end module, configured to perform a back-end sound source extraction operation to the maximum sound source signal and the at least one suppressed sound source signal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
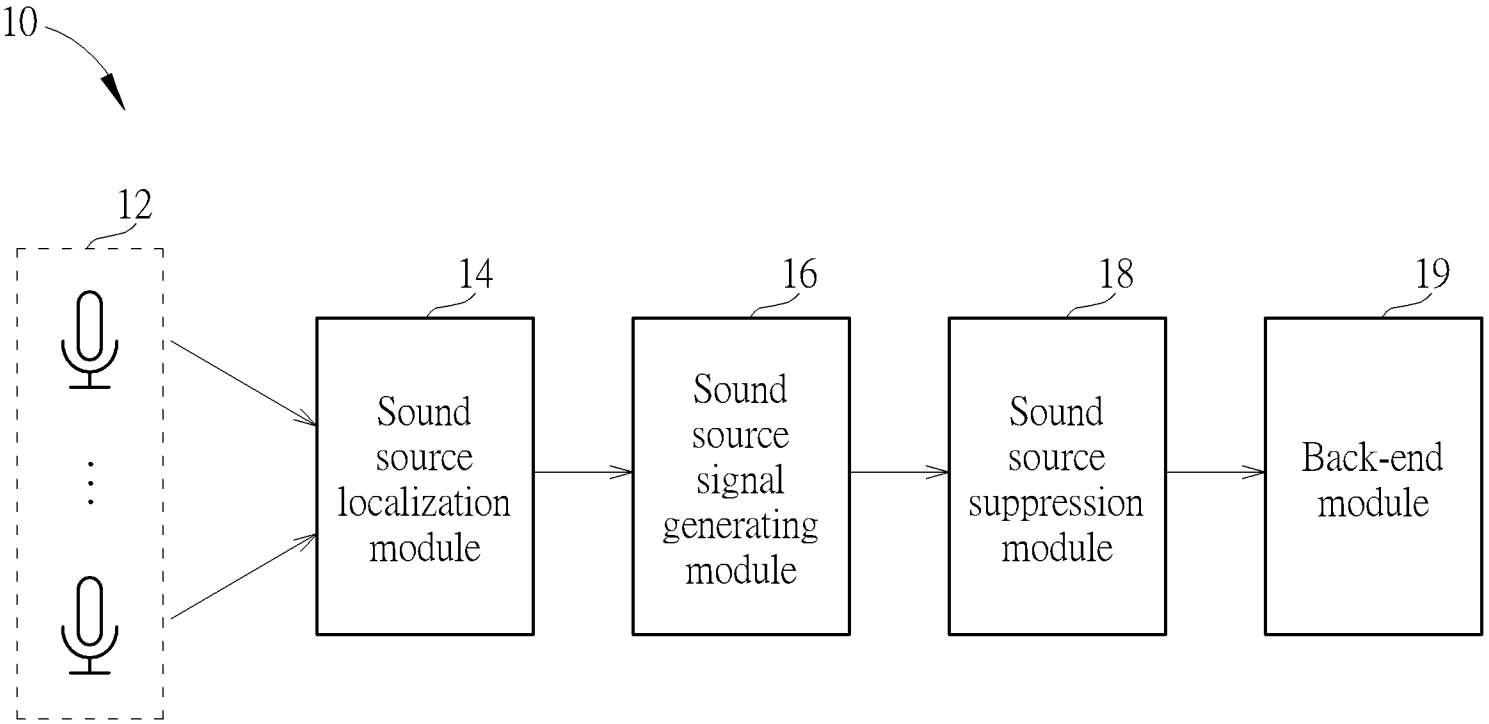
FIG. 1 is a schematic diagram of a sound system according to an embodiment of the present invention.

FIG. 1 is a schematic diagram of a sound system 10 according to an embodiment of the present invention. The sound system 10 comprises a microphone array 12, a sound source localization module 14, a sound source signal generating module 16, a sound source suppression module 18 and a back-end module 19. The microphone array 12 comprises a plurality of microphones 120_1-120_M, which may be arranged in a circular array or a linear array, and not limited thereto. In an embodiment, the sound source localization module 14, the sound source signal generating module 16, the sound source suppression module 18 and the back-end module 19 may be implemented by an application-specific integrated circuit (ASIC). In an embodiment, the sound source localization module 14, the sound source signal generating module 16, the sound source suppression module 18 and the back-end module 19 may be implemented by a processor. In other words, the sound system 10 may comprise a processor and a storage unit, to implement the function of the sound source localization module 14, the sound source signal generating module 16, the sound source suppression module 18 and the back-end module 19. The storage unit may store a program code to instruct the processor to perform a sound source separation operation. In addition, the processor may be a processing unit, an application processor (AP) or a digital signal processor (DSP), wherein the processing unit may be a central processing unit (CPU), a graphics processing unit (GPU) even a tensor processing unit (TPU), and not limited thereto. The storage unit may be a memory, which may be a non-volatile memory, such as an electrically erasable programmable read-only memory (EEPROM) or a flash memory, and not limited thereto.

Different from the prior art, the sound source suppression module 18 in the sound system 10 can perform the sound source suppression on the non-maximum sound source signal(s) according to the amplitudes of the sound source signals, to reduce the amplitude(s) or strength(s) of the non-maximum sound source signal(s). Thereby, the separation performance of the back-end source separation operation/computation is improved.

Figure 2:
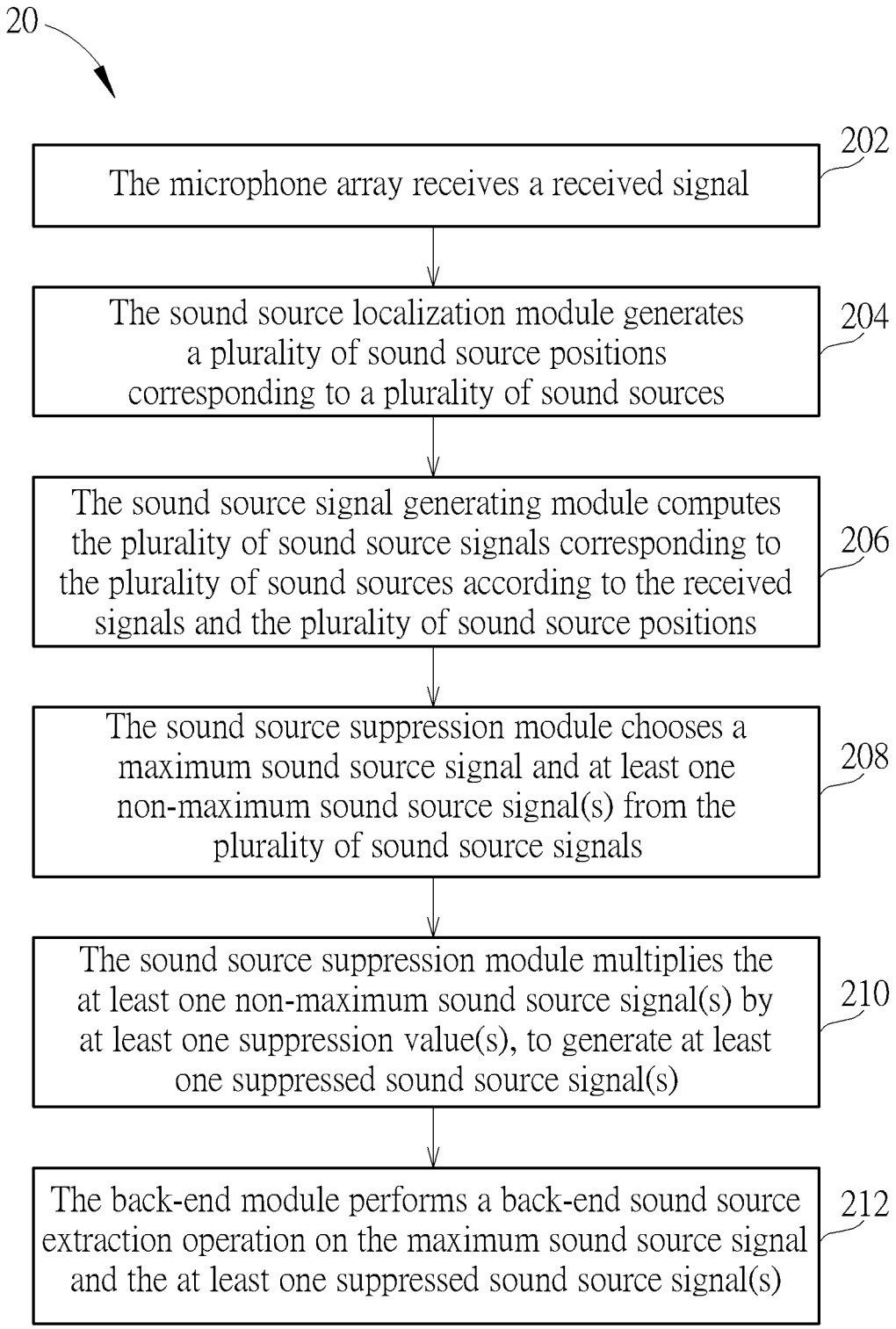
FIG. 2 is a schematic diagram of a sound source separation process according to an embodiment of the present invention.

FIG. 2 is a schematic diagram of a sound source separation process 20 according to an embodiment of the present invention. The sound source separation process 20 may be executed by the sound system 10. As shown in FIG. 2, the sound source separation process 20 comprises the following steps:

Step 202: The microphone array receives a received signal.

Step 204: The sound source localization module generates a plurality of sound source positions corresponding to a plurality of sound sources.

Step 206: The sound source signal generating module computes the plurality of sound source signals corresponding to the plurality of sound sources according to the received signals and the plurality of sound source positions.

Step 208: The sound source suppression module chooses a maximum sound source signal and at least one non-maximum sound source signal(s) from the plurality of sound source signals.

Step 210: The sound source suppression module multiplies the at least one non-maximum sound source signal(s) by at least one suppression value(s), to generate at least one suppressed sound source signal(s).

Step 212: The back-end module performs a back-end sound source extraction operation on the maximum sound source signal and the at least one suppressed sound source signal(s).

In Step 202, the microphone array 12 receives a received signal x, wherein the received signal x can be expressed as $x=[x_1, \ldots, x_M]^T$, in vector notation, wherein $x_m$ represents the signal received by the microphone 120_m. In an embodiment, the received signal x may represent that the signal is at a specific frequency $\omega_f$ in the spectrum or at a specific subcarrier k. In other words, the received signal x may represent that the signal is at the subcarrier k after the fast Fourier transformation is performed thereon. For simplicity, the index k of the subcarrier shall be omitted herein.

In Step 204, the sound source localization module 14 generates the plurality of sound source positions $(\varphi_{S,1}, \theta_{S,1})$-$(\varphi_{S,D}, \theta_{S,D})$ corresponding to a plurality of sound sources $SC_1$-$SC_D$. The plurality of sound sources $SC_1$-$SC_D$ may be scattered in a plurality of positions in the space, and $\varphi_{S,d}$ and $\theta_{S,d}$ represent the azimuth angle and the elevation angle of the sound source, respectively, where d is a sound source index, which is an integer ranging between 1 and D. In an embodiment, the sound source localization module 14 may apply the multiple signal classification (MUSIC) algorithm to perform computation/operation of the sound source positions on the plurality of sound sources, to obtain the plurality of sound source positions $(\varphi_{S,1}, \theta_{S,1})$-$(\varphi_{S,D}, \theta_{S,D})$. In an embodiment, the sound source localization module 14 may also apply the particle swarm optimization (PSO) algorithm to perform the sound source position operation. Details of performing the sound source position/localization operation with PSO algorithm has been disclosed in the U.S. application Ser. No. 16/709,933, which are not narrated herein for brevity.

In Step 206, the sound source signal generating module 16 computes the plurality of sound source signals $s_{hat.1}$-$s_{hat.D}$ corresponding to the plurality of sound sources $SC_1$-$SC_D$ according to the received signal x and the plurality of sound source positions $(\varphi_{S,1}, \theta_{S,1})$-$(\varphi_{S,D}, \theta_{S,D})$. In an embodiment, the sound source signal generating module 16 can establish an array manifold matrix A corresponding to the plurality of sound sources $SC_1$-$SC_D$ according to the topology of the microphone array 12 and the sound source positions $(\varphi_{S,1}, \theta_{S,1})$-$(\varphi_{S,D}, \theta_{S,D})$, and compute the plurality of sound source signals $s_{hat.1}$-$s_{hat.D}$ corresponding to the plurality of sound sources $SC_1$-$SC_D$ according to the array manifold matrix A. The array manifold matrix A can be expressed as $A=[a_l \ldots a_D]$, where $a_d$ is the array manifold vector formed according to the sound source positions $(\varphi_{S,d}, \theta_{S,d})$ corresponding to the sound sources $SC_d$. Moreover, the plurality of sound source signals $s_{hat.1}$-$s_{hat.D}$ may represent the sound source signals transmitted from the sound sources $SC_1$-$SC_D$ (the transmitter) and estimated/computed by the sound system 10 (the receiver) according to the sound source position $(\varphi_{S,1}, \theta_{S,1})$-$(\varphi_{S,D}, \theta_{S,D})$.

In an embodiment, the sound source signal generating module 16 can solve $s_{hat}=[s_{hat.1} \ldots s_{hat.D}]=\arg\min_s \|As-x\|^2$ (equation 1), and the solution of equation 1 (notated by $s_{hat}$) contains the plurality of sound source signals $s_{hat.1}$-$s_{hat.D}$, wherein $\|\cdot\|$ may represent the Euclidean norm. In an embodiment, the sound source signal generating module 16 may apply Tikhonov Regularization (TIKR) algorithm to compute the plurality of sound source signals $s_1$-$s_D$, in other words, the sound source signal generating module 16 can solve $[s_{hat.1} \ldots s_{hat.D}]=\arg\min_s \|As-x\|^2+\beta^2\|s\|^2$ (equation 2), and the solution $s_{hat}$ of equation 2 contains the plurality of sound source signals $s_{hat.1}$-$s_{hat.D}$, wherein $\beta^2$ is a disturbance factor, which may be determined according to practical situations or rules of thumb. In brief, the sound source signals $s_{hat.1}$-$s_{hat.D}$ can be obtained by solving equation 1 or equation 2.

In Step 208, the sound source suppression module 18 chooses a maximum sound source signal $s_{hat.max}$ and at least one non-maximum sound source signals $s_{hat.non\text{-}max}$ (or notated by $s_{hat.non\text{-}max,<1>}$-$s_{hat.non\text{-}max,<D-1>}$) from the plurality of sound source signals $s_{hat.1}$-$s_{hat.D}$. The plurality of sound source signals $s_{hat.1}$-$s_{hat.D}$ have a plurality of amplitudes $|s_{hat.1}|$-$|s_{hat.D}|$. The maximum sound source signal $s_{hat.max}$ has a maximum amplitude $|s_{hat.max}|$, which is a maximum of/among the plurality of amplitudes $|s_{hat.1}|$-$|s_{hat.D}|$. In other words, the maximum amplitude $|s_{hat.max}|$ can be expressed as $|s_{hat.max}|=\max\{|s_{hat.1}|, \ldots, |s_{hat.D}|\}$, which means that the amplitudes of all non-maximum sound source signals $s_{hat.non\text{-}max}$ are less than the maximum amplitude $|s_{hat.max}|$, i.e., $|s_{hat.non\text{-}max,<d'>}\cdot DP_{<d'>}|<|s_{hat.max}|$, wherein d' represents the index for the non-maximum sound source signal, an integer from 1 to D−1, i.e., d'=1, . . . , D−1. In addition, the set formed by the non-maximum sound source signal is the set formed by the plurality of sound source signals $s_{hat.1}$-$s_{hat.D}$ deducting/minus the maximum sound source signal $s_{hat.max}$, i.e., $\{s_{hat.non\text{-}max,<d'>}\cdot DP_{<d'>}|d'=1, \ldots, D-1\}=\{s_{hat.1}, \ldots, s_{hat.D}\}\backslash\{s_{hat.max}\}$, wherein "\" represents set minus operation.

In Step 210, the sound source suppression module 18 multiplies the non-maximum sound source signals $s_{hat.non\text{-}max,<1>}-s_{hat.non\text{-}max,<D-1>}$ by suppression values $DP_{<1>}$-$DP_{<D-1>}$, respectively, to generate suppressed sound source signals $s_{DP,<1>}-s_{DP,<D-1>}$. All of the suppression values $DP_{<1>}$-$DP_{<D-1>}$ are less than 1 (or between 0 and 1), i.e., $0<DP_{<d'>}<1$, and the suppressed sound source signal $s_{DP,<d'>}$ can be expressed as $s_{DP,<d'>}=s_{hat.non\text{-}max,<d'>}\cdot DP_{<d'>}$.

For example, suppose that the number of the sound source D=5, and the sound source signal $s_{hat.3}$ is the maximum sound source signal of/among the sound source signals $s_{hat.1}$-$s_{hat.5}$. In Step 208, the sound source suppression module 18 can obtain the sound source signalv $s_{hat.3}$ is the maximum sound source signal, and the sound source signals $s_{hat.1}$, $s_{hat.2}$, $s_{hat.4}$, $s_{hat.5}$ are the non-maximum sound source signals, in Step 210, the sound source suppression module 18 multiplies the non-maximum sound source signals $s_{hat.1}$, $s_{hat.2}$, $s_{hat.4}$, $s_{hat.5}$ by the suppression values $DP_1$, $DP_2$, $DP_4$, $DP_5$ corresponding to $s_{hat.1}$, $s_{hat.2}$, $s_{hat.4}$, $s_{hat.5}$, respectively, to generate the suppressed sound source signals $s_{hat.1}$, $s_{hat.2}$, $s_{hat.4}$, $s_{hat.5}$. Take the suppressed sound source signal $s_{DP.1}$ as an example, the suppressed sound source signal $s_{DP.1}$ can be expressed as $s_{DP.1}=s_{hat.1}\cdot DP_1$, and so on and so forth.

Methods of determining the suppression values $DP_{<1>}$-$DP_{<D-1>}$ are not limited. In an embodiment, the suppression values $DP_{<d'>}$ may decrease as the non-maximum sound source signal amplitudes $|s_{hat.non\text{-}max,<d'>}\cdot DP_{<d'>}|$ increase. In other words, the greater of the non-maximum sound source signal amplitudes $|s_{hat.non\text{-}max,<d'>}\cdot DP_{<d'>}|$ are or the more the non-maximum sound source signal amplitudes $|s_{hat.non\text{-}max,<d'>}\cdot DP_{<d'>}|$ close to the maximum amplitude $|s_{hat.max}|$, the less of suppression value $DP_{<d'>}$ would be, and vice versa.

For example, the sound source suppression module 18 can determine the suppression values $DP_{<d'>}$ as $DP_{<d'>}=(|s_{hat.max}|-|s_{hat.non\text{-}max,<d'>}\cdot DP_{21\ d'>}|)/|s_{hat.max}|$ (equation 3.) Consequently, the suppression values $DP_{<d'>}$ satisfy the criteria between 0 and 1, and satisfy the limitation that decreases as the non-maximum sound source signal amplitude $|s_{hat.non\text{-}max,<d'>}\cdot DP_{21\ d'>}|$ increases. In other words, the suppression values $DP_{<d'>}$ are proportional to the difference $(|s_{hat.max}|-|s_{hat.non\text{-}max,<d'>}\cdot DP_{21\ d'>}|)$, and the suppression values $DP_{<d'>}$ are the difference $(|s_{hat.max}|-|s_{hat.non\text{-}max,<d'>}\cdot DP_{21\ d'>}|)$ divided by the maximum amplitude $|s_{hat.max}|$. Consequently, the sound source signal is more suppressed (i.e., the less suppression value it is) when the signal amplitude is closer to the maximum amplitude $|s_{hat.max}|$. Moreover, the suppression values are adaptive to the signal strength (as shown in equation 3), which can avoid the sound quality degradation due to too much suppression.

In Step 212, the back-end module 19 performs a back-end sound source extraction operation on the maximum sound source signal $s_{hat.max}$ and the suppressed sound source signals $s_{DP,<1>}$-$s_{DP,<D-1>}$.

Details of the back-end sound source extraction are known by one skilled in the art. For example, the back-end module 19 performs the inverse Fourier transformation to the spectrogram, inputted to the neural network to classify, and the back-end module 19 may be in the architecture of the VGG-like convolutional neural network to extract the characteristics of time-frequency effectively. During the model training, the back-end module 19 may induce the technique of data augmentation, by collecting room impulse response from different rooms and mixing large and small noises, to make the classification model more robust.

In addition, Steps 204, 206, 208 and 210 of the sound source separation process 20 may be regarded as operations performed with respect to the subcarrier k. In an embodiment, the sound system 10 may perform the operations of Step 204, 206, 208 and 210 on all of the subcarriers (wherein the subcarrier indices may be 1-$N_{FFT}$) to obtain the non-maximum sound source signals of all subcarriers and the suppressed sound source signals. The sound system 10 may perform the inverse Fourier transformation in Step 212 on the non-maximum sound source signals and the suppressed sound source signals of all subcarriers, and to accomplish the back-end sound source extraction operation performed by the back-end module 19.

In the prior art, the diaphragm of loudspeaker is not a point source assumed by the acoustic model, it, therefore, exists a problem that the signal separation is not sufficiently clear during the experiment of performing the sound source signal separation with TIKR algorithm. In order to solve the problem of the sound source signal separation being not sufficiently clear, the sound system 10 performs Step 208 and 210 (by the sound source suppression module 18) to suppress the non-maximum sound source signals. That is, the non-maximum sound source signals are multiplied by the corresponding suppression values. Hence, the separation performance carried by the back-end sound source extraction operation can be improved, the quality of sound separation at the front-end is enhanced, and the successful recognition rate of the consecutive sound recognition is also enhanced.

In summary, in addition to generating the sound source signal using TIKR algorithm, the present invention further utilizes the sound source suppression module to perform the sound suppression on the non-maximum sound source signal. Therefore, the separation performance of the back-end sound source extraction operation is improved and the successful recognition rate of the consecutive sound recognition is also enhanced.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A sound source separation method, applied to a sound system, wherein the sound system comprises a microphone array, a sound source localization module, a sound source signal generating module, a sound source suppression module, and a back-end module, the method comprising:

the microphone array receiving a received signal;

the sound source localization module generating a plurality of sound source positions corresponding to a plurality of sound sources;

the sound source signal generating module computing a plurality of sound source signals corresponding to the plurality of sound sources according to the received signal and the plurality of sound source positions;

the sound source suppression module choosing a maximum sound source signal and at least one non-maximum sound source signal from the plurality of sound source signals, wherein the plurality of sound source signals have a plurality of amplitudes, and the maximum sound source signal has a maximum amplitude among the plurality of amplitudes;

the sound source suppression module multiplying the at least one non-maximum sound source signal by at least one suppression value, to generate at least one suppressed sound source signal, wherein the at least one suppression value is less than 1; and the back-end module performing a back-end sound source extraction operation on the maximum sound source signal and the at least one suppressed sound source signal;

wherein a first suppression value of the at least one suppression value decreases as a first amplitude increases, and the first suppression value is corresponding to a first non-maximum sound source signal of the at least one non-maximum sound source signal, and the first non-maximum sound source signals has the first amplitude.

2. The sound source separation method of claim 1, wherein the first suppression value is proportional to a difference, and the difference is the maximum amplitude minus the first amplitude.

3. The sound source separation method of claim 2, wherein the first suppression value is the difference divided by the maximum amplitude.

4. The sound source separation method of claim 1, wherein the received signal and the plurality of sound source signal are at a specific frequency.

5. A sound source suppression method, applied to a sound source suppression module, comprising:

receiving a plurality of sound source signals corresponding to a plurality of sound sources;

choosing a maximum sound source signal and at least one non-maximum sound source signal from the plurality of sound source signals, wherein the plurality of sound source signals have a plurality of amplitudes, and the maximum sound source signal has a maximum amplitude of the plurality of amplitudes;

multiplying the at least one non-maximum sound source signals by at least one suppression value, to generate at least one suppressed sound source signal, wherein the at least one suppression value is less than 1; and sending the maximum sound source signal and the at least one suppressed sound source signal to a back-end module;

wherein the back-end module performs a back-end sound source extraction operation on the maximum sound source signal and the at least one suppressed sound source signal;

wherein a first suppression value of the at least one suppression value decreases as a first amplitude increases, and the first suppression value is corresponding to a first non-maximum sound source signal of the at least one non-maximum sound source signal, and the first non-maximum sound source signal has the first amplitude.

6. The sound source suppression method of claim 5, wherein the first suppression value is proportional to a difference, and the difference is the maximum amplitude minus the first amplitude.

7. The sound source suppression method of claim 6, wherein the first suppression value is the difference divided by the maximum amplitude.

8. The sound source suppression method of claim 5, wherein the received signal and the plurality of sound source signal are at a specific frequency.

9. A sound system, comprising:

a microphone array, configured to receive a received signal;

a sound source localization module, configured to generate a plurality of sound source positions corresponding to a plurality of sound sources;

a sound source signal generating module, configured to calculate the plurality of sound source signals corresponding to the plurality of sound sources according to the received signal and the plurality of sound source positions;

a sound source suppression module, configured to perform the following steps:

choosing a maximum sound source signal and at least one non-maximum sound source signal from the plurality of sound source signals, wherein the plurality of sound source signals have a plurality of amplitudes, and the maximum sound source signal has a maximum amplitude among the plurality of amplitudes; and multiplying the at least one non-maximum sound source signal by at least one suppression value, to generate at least one suppressed sound source signal, wherein the at least one suppression value is less than 1; and a back-end module, configured to perform a back-end sound source extraction operation on the maximum sound source signal and the at least one suppressed sound source signal;

wherein a first suppression value of the at least one suppression value decreases as a first amplitude increases, and the first suppression value is corresponding to a first non-maximum sound source signal of the at least one non-maximum sound source signal, and the first non-maximum sound source signal has the first amplitude.

10. The sound system of claim 9, wherein the first suppression value is proportional to a difference, and the difference is the maximum amplitude minus the first amplitude.

11. The sound system of claim 10, wherein the first suppression value is the difference divided by the maximum amplitude.

12. The sound system of claim 9, wherein the received signal and the plurality of sound source signal are at a specific frequency.

* * * * *